United States Patent [19]

Halstead

[11] 4,335,477

[45] Jun. 22, 1982

[54] CABLE TIE INSTALLING AND RELEASING TOOL

[76] Inventor: William M. Halstead, 5484 Cedar La., Apt. B-1, Columbia, Md. 21044

[21] Appl. No.: 168,313

[22] Filed: Jul. 10, 1980

[51] Int. Cl.[3] ..... B26B 11/00

[52] U.S. Cl. ..... 7/158; 81/3 R

[58] Field of Search ..... 7/158; 81/3 R; 29/235, 29/270, 278

[56] References Cited

U.S. PATENT DOCUMENTS

| | | | |
|---|---|---|---|
| 3,584,525 | 6/1971 | Caveney | 81/3 R |
| 4,121,329 | 10/1978 | Sugiyama | 81/3 R X |
| 4,197,626 | 4/1980 | Golovich | 29/270 |

*Primary Examiner*—James G. Smith

*Attorney, Agent, or Firm*—Munson H. Lane; Munson H. Lane, Jr.

[57] ABSTRACT

A tool is disclosed for installing and releasing one-piece cable ties of the self-locking type which include an elongated strap having a series of pawl engaging detents thereon, and a head at one end thereof provided with an opening therethrough for receiving the other end of the strap and a pawl yieldably mounted in the head inclined partially across the opening for engagement with at least one of the detents on the strap when the other end of the strap is inserted through the opening. The tool comprises an elongated shank having a handle portion and a blade support portion forward of the handle portion, and a thin flat primary blade projecting outwardly from the blade support portion and insertable in the head of the cable tie between the strap and the pawl to release the pawl from engagement with detents on the strap so that the other end of the strap may be withdrawn from the head. An opening through the shank of the tool receives the other end of the strap therethrough whereby the tool may be used in installing the cable tie or used in releasing a twist type cable tie.

9 Claims, 11 Drawing Figures

CABLE TIE INSTALLING AND RELEASING TOOL

BACKGROUND OF THE INVENTION

1. Field of the Invention

This invention relates to an improved tool for use in installing and releasing cable ties, particularly those of the self-lock and twist lock types.

2. Discussion of the Prior Art

One-piece cable ties of molded plastic materials have come into common use for tightly binding a cable bundle made up of plural cable strands, wires and the like. The one-piece ties include an elongated strap integrally connected at one end to a head having an entry surface, an exit surface and a strap receiving opening therethrough. The self-locking cable ties which the present invention is particularly designed to release have a series of pawl engaging detents on one side of the strap and a yieldably mounted pawl in the head of the cable tie inclined across the opening therein. The pawl is movable between a position in engagement with at least one of the pawls of said series and a disengaged position out of engagement with said pawl engaging detents.

Representative examples of patents relating to cable ties of the self-locking type are:

U.S. Pat. No. 3,186,047
U.S. Pat. No. 3,408,699
U.S. Pat. No. 3,590,442

The self-locking cable ties cannot be readily released manually without the use of a releasing tool. The common practice has therefore developed, when release of the self-locking cable tie is desired, to cut the strap encircling the cable bundle, usually behind the tie head. Cutting the cable tie results in the tie having to be discarded which is wasteful both of materials and money. A simple economical tool which is efficient for use in releasing the self-locking cable tie so that it can be used over and over again is needed.

The present invention meets the aforesaid need and in addition it is useful for tightening the tie and for cutting off excess lengths of the tie strap when installing the tie.

The present invention is also useful for twisting a twist-lock cable tie to lock and unlock same. The following representative patents illustrate cable ties of the twist-lock type:

U.S. Pat. No. 3,022,557
U.S. Pat. No. 3,047,945
U.S. Pat. No. 3,154,114
U.S. Pat. No. 3,168,119

The following patent discloses a prior art device for use in releasing a one-piece cable tie of the self-lock type:

U.S. Pat. No. 3,584,525

While the tool disclosed in U.S. Pat. No. 3,584,525 is intended to accomplish the same result of releasing a self-lock cable tie as the present invention, structurally and operationally the tool disclosed in U.S. Pat. No. 3,584,525 is very different from the present invention as described and claimed herein.

SUMMARY OF THE INVENTION

The invention comprises a simple, economical and easily manipulatable hand tool for use in the installation of one-piece cable ties, and for use in the release of self-lock and twist-lock cable ties.

It is an object of this invention to provide an easily manufactured simple hand tool for the release of self-lock cable ties which includes an elongated shank preferably made of metal, but which may also be made of other durable materials such as rigid plastics, and a thin, flat primary blade mounted on one end of the shank. The primary blade has a pawl engaging portion which projects outwardly from the one end of the shank which is referred to herein as the blade supporting shank portion to distinguish from the handle portion of the shank at the opposite end thereof. The pawl engaging blade portion is narrower than the opening in the head of the cable tie and it is sufficiently thin to be inserted between the pawl and the pawl engaging detents of the strap to release the strap so that the strap may be pulled back through the entry side of the head opening and removed from the cable bundle without the destruction of the tie.

In one embodiment of the invention, the blade engaging portion of the shank is offset from the handle portion in a plane parallel to the handle engaging portion, and it is connected to the handle portion by a right angle portion. The pawl engaging portion of the primary blade extends outwardly from the free end of the blade support portion of the shank and laterally therefrom at approximately 90°. The primary blade is mounted beneath the blade support portion of the shank on the side opposite from the handle portion. A secondary blade of substantially the same shape as the primary blade is mounted on top of said blade support portion, and it has a laterally projecting portion which lies in a plane parallel to and above the plane of the pawl engaging portion of the primary blade. The laterally projecting portions of said primary and secondary blades are spaced apart a distance equal to the thickness of the shank which is slightly greater than the thickness of a cable tie of the greatest thickness for which the tool is designed for use.

In use, the tool of the first embodiment is held in one hand by an operator with the shank extended perpendicular to the tie strap.

A second embodiment of the invention includes a linear shank having a fixed blade and a sliding blade projecting laterally from the blade support portion of the shank. The sliding blade is hook-shaped and has a pawl engaging portion which is spaced outwardly from the shank and extends parallel thereto in a rearward direction. The second embodiment tool is intended to be held alongside of and generally parallel to the cable tie strap when manipulating the tool to insert the pawl engaging portion of the sliding blade between the pawl and the pawl engaging detents on the tie strap.

It is a further object of this invention to provide a strap receiving opening in the shank of the tools of this invention so that the strap end of a cable tie may be inserted through the opening and the tool pushed up against the exit surface of the tie head while the strap end is being pulled outwardly for tightening the cable tie around a wire bundle. By rotating the handle 90°, the strap may be twisted 90° to lock or unlock the strap relative to the head of a twist-lock cable tie.

It is still a further object of this invention to fasten a cutter bar on the shank of the tools of this invention for the purpose of cutting off the excess length of a tie strap end.

BRIEF DESCRIPTION OF THE DRAWINGS

With the foregoing more important objects and features in view and such other objects and features which may become apparent as this specification proceeds, the invention will be understood from the following description taken in conjunction with the accompanying drawings, in which like characters of reference are used to designate like parts, and in which.

DETAILED DESCRIPTION OF THE PREFERRED EMBODIMENTS

Figure 1:
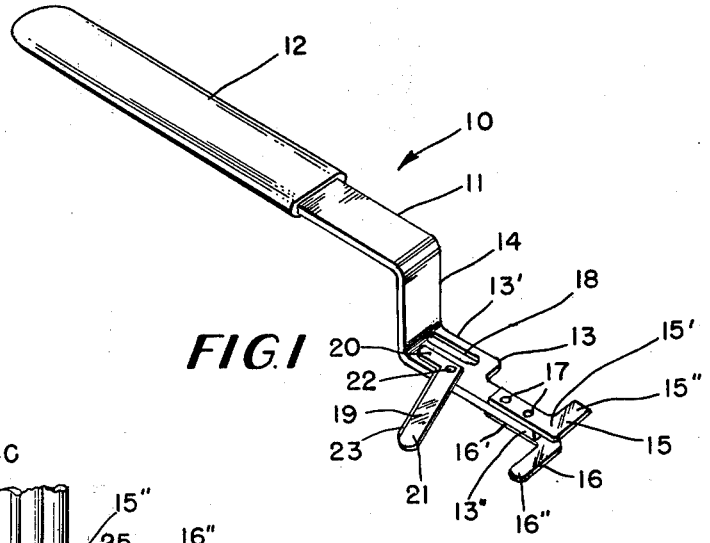
FIG. 1 is a perspective view of one embodiment of the cable tie installation and release tool of this invention.

Referring now to the drawings and particularly to FIGS. 1 through 6, there is shown a first embodiment of a cable tie installation and releasing tool 10 constructed in accordance with the concepts of the invention. Looking particularly at FIG. 1 the tool 10 comprises an elongated shank 11 having a flat handle portion 12, a flat offset portion parallel with the handle portion and a connecting portion 14 bent at right angles to the handle portion 12 and to the offset portion 13 and a pair of blades 15 and 16 attached respectively to the top and bottom surfaces of the offset portion 13 at the free end thereof opposite the intermediate portion 14 by suitable fastening means such as rivets 17. The offset portion 13 has a wide base portion 13′ where it is joined to the connecting portion 14 and a narrow free end portion 13″. The blades 15 and 16 each have a flat shank portion 15′ and 16′ respectively extending longitudinally along the free end portion 13″ on opposite sides thereof and right angle blade portions 15″ and 16″ respectively which projects laterally with respect to the free end portion 13″ beyond the end thereof and in opposite directions. The blade portions 15″ and 16″ are separated by a distance d equal to the thickness of the free end portion 13″. The distance d between the blades is slightly greater than the thickness of the thickest cable tie for which the tool is designed to be used so that the blades will straddle a cable tie and slide relative to the opposite surfaces of the tie.

The tool 10 also includes an elongated slot 18 formed in the base 13′ of the offset portion 13. The slot 18 is of a length and width exceeding the width and thickness of a cable tie so as to freely receive the end of a cable tie strap within the slot allowing the tool 10 to be moved along the cable tie strap.

A cutter bar 19 including a base portion 20 attached to the base of the offset portion 13 by a rivet 22 and a cutter portion 21 extending laterally from the base at an angle less than 90° is provided as means for cutting off excess lengths of the cable tie after the cable tie is tightened around a cable bundle. The blade portion is sharpened along one edge as shown at 23.

Figure 2:
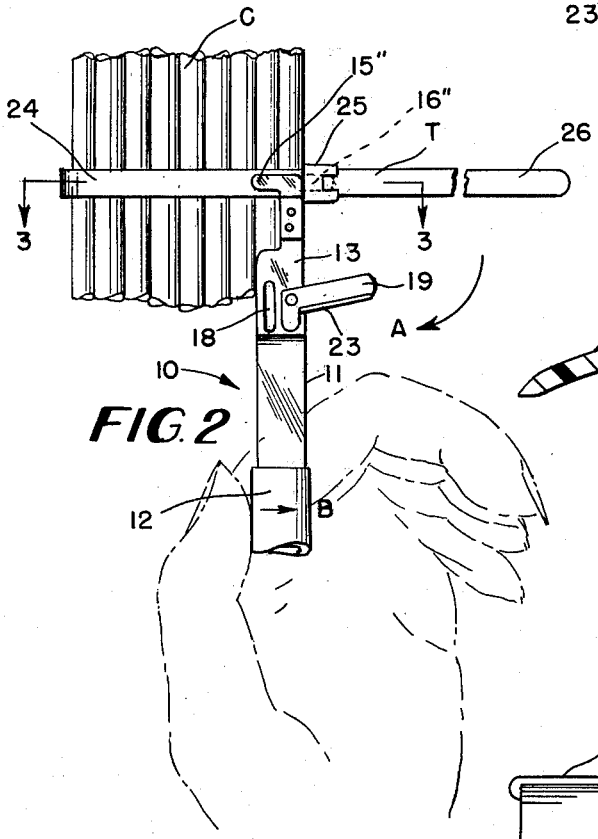
FIG. 2 is a partial top plan view of the tool shown in FIG. 1 illustrating the manner of using the tool to release one type of cable tie.
Figure 3:
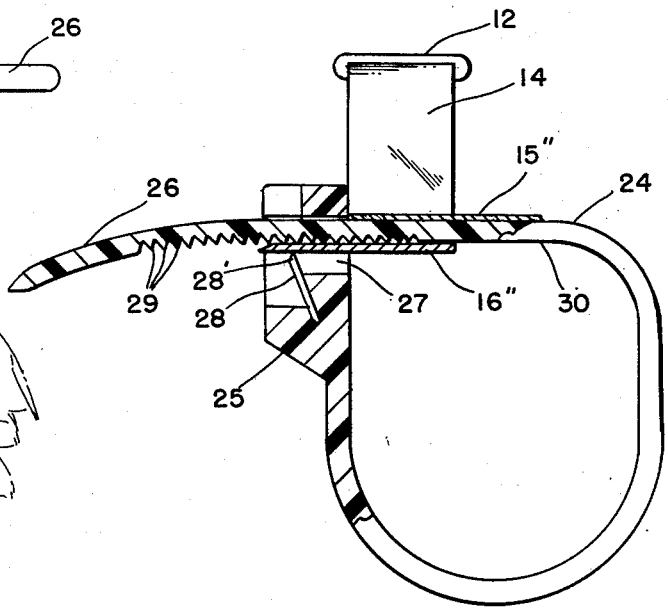
FIG. 3 is an enlarged sectional view taken on line 3—3 of FIG. 2.

The use of the tool 10 to release one type of plastic cable tie T is shown in FIGS. 2 and 3 of the drawings. The cable tie T includes a strap portion 24 and a head portion 25 which has a slot 27 formed therein to receive the end 26 of the strap 24 therethrough. A thin metal pawl 28 of generally rectangular shape has one end fixed in the head portion below the slot 27 and as opposite end with a knife edge 28″ projecting angularly across the slot 27 so as to normally engage the ribs 29 on the underside 30 of the strap end portion 26. Ties of the type T are manufactured by Thomas and Betts Co. and are illustrated for example in U.S. Pat. No. 3,408,699 and others. When the strap end 26 is pulled through the slot 27, the ribbed undersurface of the strap slides over the knife edge 28′, however a force tending to pull the strap back through the slot 18 will force the inclined pawl 28 against one of the ribs on the undersurface of the strap 24 and thus will prevent withdrawal of the strap end from the head 25.

To release the strap 24 from the head portion 25, the tool 10 is first pushed over the strap portion of the tie behind the head 25 so that the blade portions 15″ and 16″ of the tool straddle the strap 24 and extend longitudinally thereof. Pressure is then applied to the handle 12 of the tool in the direction as indicated by arrow B in FIG. 2 to force the lower blade 16″ into the aperture 22 of the tie head between the inclined pawl 28 and the underside of the strap. The strap 24 can then be pulled out of the head 25 without interference from the pawl 28.

Figure 4:
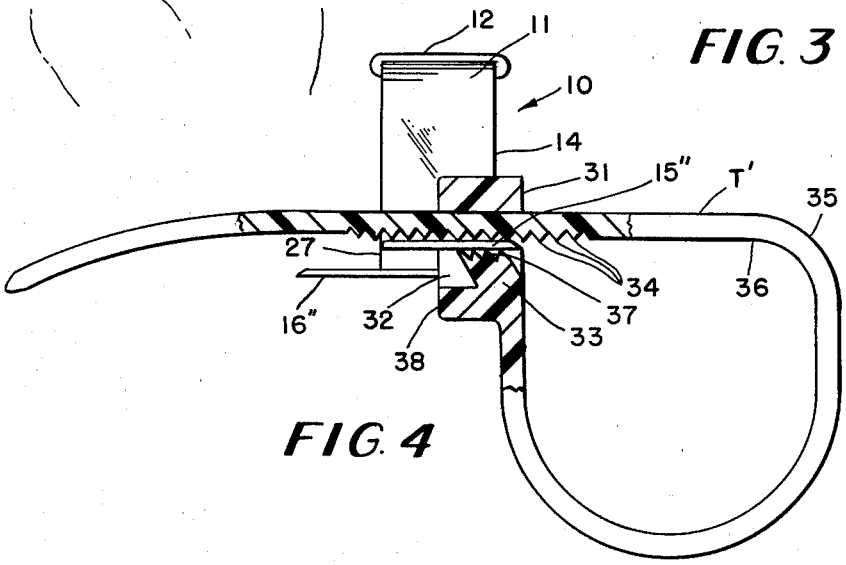
FIG. 4 is a sectional view through another type of cable tie showing the tool of FIG. 1 positioned for the release thereof.

FIG. 4 shows the tool 10 positioned to release the plastic locking pawl of another type of self-locking plastic cable tie T′. The cable tie T′ has a plastic head 31, with an aperture 32 therein, and an inclined plastic pawl 33 which extends part way across the aperture 32 so as to bear against the undersurface 36 of tie strap portion 35. The strap undersurface 36 has a series of projections or ribs 34 which are engaged by the toothed free end 37 of the pawl 33 when an attempt is made to pull the strap 35 out of the tie head 31. Insertion of the upper blade portion 15″ into the apertures 32′ between the plastic locking pawl 33 and the underside 36 of the cable tie strap releases the strap from the pawl so that the strap end can be pulled easily from the head portion 31.

Although a cable bundle is not shown bound by the cable ties in FIGS. 3 and 4 it will be understood that the ties T and T′ as shown in FIGS. 3 and 4 respectively would tightly encircle a cable bundle C in the manner shown in FIG. 2.

Figure 5:
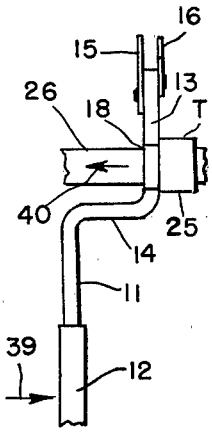
FIG. 5 is a partial view of the tool shown in FIG. 1 illustrating its use for tightening a cable tie.
Figure 7:
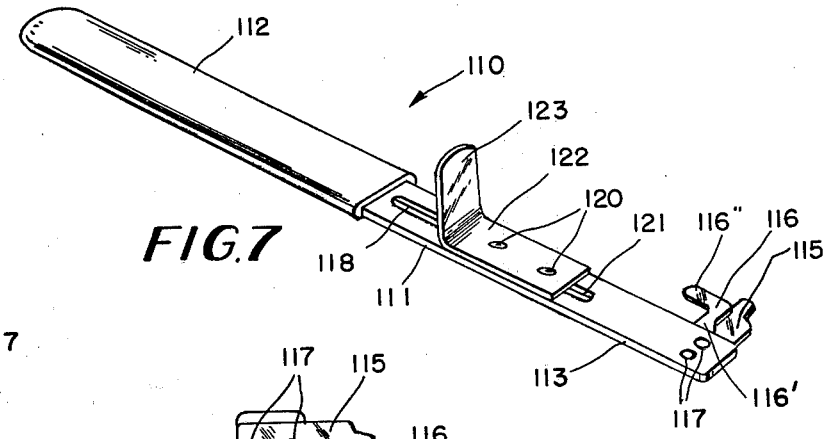
FIG. 7 is a perspective view of another embodiment of the cable tie installation and release tool of this invention.
Figure 6:
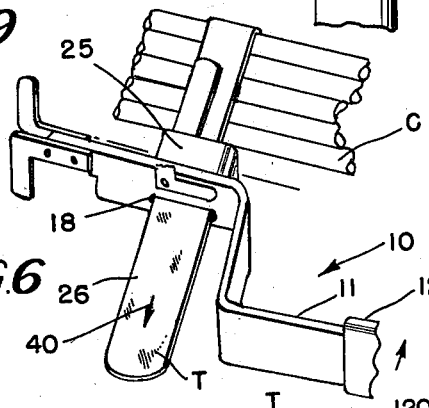
FIG. 6 is a partial perspective view of the tool shown in FIG. 5 being used for tightening a cable tie.

FIGS. 5 and 6 illustrate the tool 10 being used to tighten a cable tie T about a cable bundle C. With the cable tie T placed around a cable bundle and the strap end 26 passed through the opening in the tie head 25, the tool 10 is held approximately as shown in FIG. 6 with the right hand and the strap end 26 is passed through the slot 18 in the tool 10. The tool will then be pushed against the tie head in the direction of arrow 39 and the tie end 26 will be pulled outwardly in the direction of arrow 40. The aforesaid action reduces the diameter of the strap encircling the cable bundle and tightens the tie about the bundle producing a compact cable bundle C. The cutter bar 19 is omitted from the drawing in FIGS. 5 and 6 to better show the function of the tool 10 in tightening a cable tie. The cutter bar 19, however, will not interfere with the function of tool 10 as a cable tie tightening tool, because the cutter bar will extend upwardly in a plane substantially perpendicular to the cable strap 26.

It will be apparent that by rotating the handle 12 of the tool 10, as shown in FIG. 6, 90° clockwise or counterclockwise to the position shown in FIG. 6, a 90° twist can be given to the cable tie strap end 26 relative to the head portion 25. If the tie T, instead of having a head with a self locking pawl, were of the twist lock type, illustrated for example in U.S. Pat. No. 3,047,947, the tool 10 can be readily used in making the twist for locking the tie strap relative to the tie head.

Figure 8:
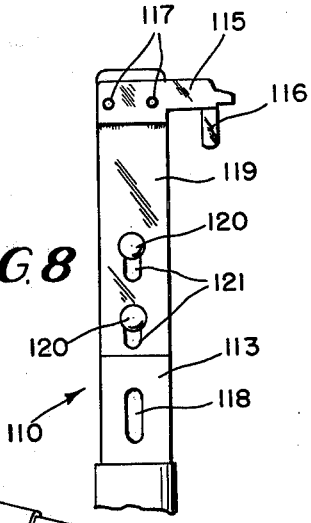
FIG. 8 is a partial bottom plan view of the tool shown in FIG. 7.

A second embodiment 110 of the invention is illustrated in FIGS. 7–11. The tool 110, best seen in FIG. 7, includes a straight shank 111 having a handle portion 112 and a blade support portion 113 opposite the handle portion. A fixed blade 115 extends laterally from beneath the blade support portion 113 near the free end thereof and a sliding blade 116 is mounted on the underside of the blade portion 113 to slide over the fixed blade 115. FIG. 8 shows the bottom side of the tool 110 where the shape of the fixed blade 115 is clearly shown. The fixed blade is supported on the end of the shank 111 by rivets 117. The sliding blade 116 is supported from a rectangular base plate 119 of substantially the same width as the shank 111. The base plate 119 is slidable mounted on the bottom side of the shank 111 by a pair of longitudinally spaced rivets 120 which extend through a pair of longitudinally aligned elongated guide slots 121 in the blade support portion 113 of the shank 111. A slide actuator 122 mounted on the upper side of the shank 111 is rigidly connected with the sliding base plate 119 by the rivets 120. The slide actuator 122 includes an upstanding fingerpiece 123 for moving the slide actuator. The hook shaped sliding blade 116 includes a portion 116' which is attached to the base plate 119 and projects laterally therefrom in the same direction as the fixed blade 115, and a right angle portion 116'' which extends rearwardly toward the handle portion 112, substantially parallel with the shank 111 but spaced laterally therefrom. The fixed blade 115 gives support to the hook shaped sliding blade 116 to prevent breakage thereof when in use.

Figure 9:
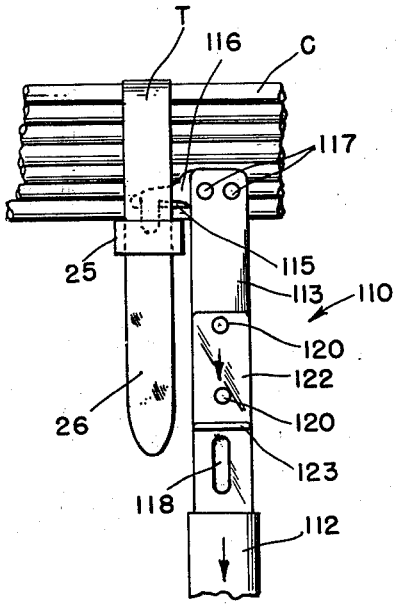
FIG. 9 is a partial top plan view of the tool shown in FIG. 7 illustrating the first stage of applying the tool to release one type of cable tie.
Figure 10:
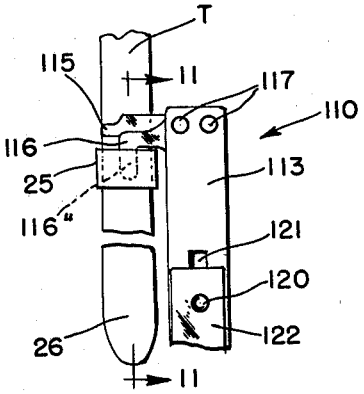
FIG. 10 is a partial top plan view of the tool as shown in FIG. 9 but with its movable blade pulled between the wedge lock of the cable tie and the cable tie strap.
Figure 11:
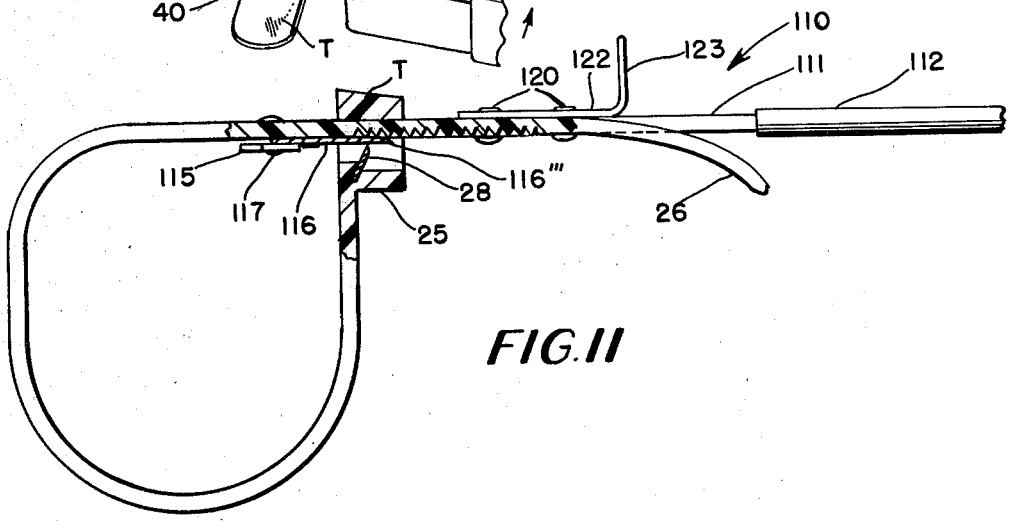
FIG. 11 is a sectional view taken on line 11—11 of FIG. 10.

FIG. 9 shows the tool 110 in the first stage of use for releasing a cable tie T of the same type illustrated in FIG. 3 of the drawings which requires that a thin blade be inserted between the metal pawl 28 of the tie and the underside of the tie strap 26. The movable blade 116 is slid forward to overlie the fixed blade for lateral insertion of the fixed blade and movable blade between the cable bundle C and the underside of the tie strap 26. The two blades 115 and 116 are then worked laterally under the tie strap behind the tie head to the position shown in FIG. 9. The handle 112 is then tugged rearwardly and while the handle is pulled rearwardly, the slide actuator 122 is pulled rearwardly relative to the shank 111 by the operator's finger engaging the finger piece 123. FIGS. 10 and 11 show the sliding blade 116 fully retracted relative to the fixed blade with the blade portion 116'' inserted between the metal pawl 28 and the underside of the tie strap. The end of the blade portion 116'' is beveled to facilitate the insertion of the sliding blade between the pawl 28 and the strap 26.

The invention has been described in detail for the purpose of illustration, but it will be obvious that numerous modifications and variations may be resorted to within the spirit and scope of the invention without departing from the claims.

What is claimed is:

1. A tool for installing and releasing one-piece cable ties of the self-locking type including an elongated strap having a series of pawl engaging detents thereon, and a head connected integrally to one end of the strap, the head having an entry surface and an exit surface and a strap receiving opening therethrough, a pawl yieldably mounted in said head and inclined across said opening and being movable between a position in engagement with at least one of said series of pawl engaging detents and a disengaged position out of engagement with the pawl engaging detents, said tool comprising an elongated shank including a handle portion and a blade support portion forward of said handle portion, a thin flat primary blade including a base portion mounted on said blade support portion of said shank and a pawl release portion projecting from said base portion outwardly from said shank, said pawl release portion of said blade being narrower than the opening in said head and sufficiently thin to enter said opening and slide between said pawl and said pawl engaging detents on said strap so as to move said pawl to its disengaged position enabling said strap to be withdrawn from said head, and a cutter bar mounted on said shank behind said primary blade with a cutter blade portion projecting laterally from said shank for cutting said strap.

2. A tool for installing and releasing one-piece cable ties of the self-locking type including an elongated strap having a series of pawl engaging detents thereon, and a head connected integrally to one end of the strap, the head having an entry surface and an exit surface and a strap receiving opening therethrough, a pawl yieldably mounted in said head and inclined across said opening and being movable between a position in engagement with at least one of said series of pawl engaging detents and a disengaged position out of engagement with the pawl engaging detents said tool comprising an elongated shank including a handle portion and a blade support portion forward of said handle portion, a thin flat primary blade including a base portion mounted on said blade support portion of said shank and a pawl release portion projecting from said base portion outwardly from said shank, said pawl release portion of said blade being narrower than the opening in said head and sufficiently thin to enter said opening and slide between said pawl and said pawl engaging detents on said strap so as to move said pawl to its disengaged position enabling said strap to be withdrawn from said head, said pawl engaging portion of said blade projecting outwardly beyond the free end of said blade support portion of said shank and laterally therefrom, and a second blade mounted on the opposite side of said blade support portion of said shank having a laterally outwardly projecting portion which entends parallel to the pawl engaging portion of said primary blade in an opposite direction, the outwardly projecting portion of said second blade and said pawl release portion of said primary blade being spaced apart for straddling the thickness of a cable tie strap, and serving to guide the pawl engaging portion of said primary blade in parallel with the strap of the cable tie as said pawl engaging portion is forced to enter the opening in the head of the cable tie.

3. The tool according to claim 2 wherein said blade support portion of said shank is offset from the handle portion of said shank and is integrally connected to the handle portion by a right angle connecting portion.

4. A tool for installing and releasing one-piece cable ties of the self-locking type including an elongated strap having a series of pawl engaging detents thereon, and a head connected integrally to one end of the strap, the head having an entry surface and an exit surface and a strap receiving opening therethrough, a pawl yieldably mounted in said head and inclined across said opening and being movable between a position in engagement with at least one of said series of pawl engaging detents and a disengaged position out of engagement with the pawl engaging detents, said tool comprising an elongated shank including a handle portion and a blade support portion forward of said handle portion, a thin flat primary blade including a base portion mounted on said blade support portion of said shank and a pawl release portion projecting from said base portion outwardly from said shank, said pawl release portion of said blade being narrower than the opening in said head and sufficiently thin to enter said opening and slide between said pawl and said pawl engaging detents on said strap so as to move said pawl to its disengaged position enabling said strap to be withdrawn from said head, said primary blade being slidably mounted on said blade support portion of said shank, said tool further having a slide actuator for said sliding primary blade, and a fixed blade mounted on said blade support portion of said shank and projecting outwardly therefrom, said fixed blade being spaced from the blade support portion of said shank with said pawl engaging portion of said primary blade interposed between said fixed blade and said blade support portion of said shank, said pawl engaging portion of said primary blade being hook shaped and including a portion projecting laterally from the blade support portion of said shank and a right angle portion integral with the outer end of said laterally projecting portion which extends substantially parallel to the shank and is spaced laterally outwardly therefrom.

5. The tool according to claim 4 wherein said slide actuator is slidably mounted on the side of said blade support portion opposite to the side on which the sliding blade is mounted, said slide actuator being connected to said sliding blade by fasteners which extend through guide slots in said blade support portion of said shank and having an upstanding finger piece for manually moving said slide actuator by an operator's finger while the tool is held in an operator's hand.

6. The tool according to claim wherein said shank has en elongated strap receiving opening extending therethrough for receiving the free end of the cable tie strap so that said shank may be slid over said strap into engagement with the exit surface of said head where the tool may be held by an operator while manually pulling the free end of said strap through the head and said opening in said shank to tighten the strap around a cable bundle.

7. The tool according to claim 4 wherein the pawl release portion of said primary blade has a beveled outer end remote from said base portion of said blade.

8. The tool according to claim 2 wherein the pawl release portion of said primary blade has a beveled outer end remote from said base portion of said blade.

9. The tool according to claim 2 wherein said shank has an elongated strap receiving opening extending therethrough for receiving the free end of the cable tie strap so that said shank may be slid over said strap into engagement with the exit surface of said head where the tool may be held by an operator while manually pulling the free end of said strap through the head and said opening in said shank to tighten the strap around a cable bundle.

* * * * *